US010211583B2

(12) United States Patent
Liao

(10) Patent No.: US 10,211,583 B2
(45) Date of Patent: Feb. 19, 2019

(54) AUTOMATIC UNIVERSAL POWER SOCKET

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 0 days.

(21) Appl. No.: 15/879,606

(22) Filed: Jan. 25, 2018

(65) Prior Publication Data

US 2018/0212383 A1 Jul. 26, 2018

(30) Foreign Application Priority Data

Jan. 26, 2017 (TW) ..... 106103178 A

(51) Int. Cl.

| | |
|---|---|
| ***H01R 27/00*** | (2006.01) |
| ***H01R 27/02*** | (2006.01) |
| ***H01R 13/703*** | (2006.01) |
| ***H01R 13/453*** | (2006.01) |
| ***H01R 13/652*** | (2006.01) |
| ***H01R 31/06*** | (2006.01) |
| ***H01R 13/70*** | (2006.01) |
| ***H01R 24/78*** | (2011.01) |

(52) U.S. Cl.

CPC ..... *H01R 27/00* (2013.01); *H01R 13/4532* (2013.01); *H01R 13/652* (2013.01); *H01R 13/701* (2013.01); *H01R 13/7031* (2013.01); *H01R 24/78* (2013.01); *H01R 27/02* (2013.01); *H01R 31/06* (2013.01)

(58) Field of Classification Search

CPC ..... H01R 27/00; H01R 31/06

See application file for complete search history.

(56) References Cited

U.S. PATENT DOCUMENTS 3,984,700 A * 10/1976 Sheridan ..... G04F 3/06 307/139
4,386,333 A * 5/1983 Dillan ..... H01F 29/00 336/107
4,856,885 A * 8/1989 Fimeri ..... B60R 1/072 359/874
4,890,008 A * 12/1989 Chu ..... A47G 33/126 307/149
5,369,352 A * 11/1994 Toepfer ..... B60L 3/0069 320/110
5,595,251 A * 1/1997 Cook, Jr. ..... B23P 19/065 173/178
5,744,934 A * 4/1998 Wu ..... H01R 13/6675 307/150
5,898,240 A * 4/1999 Tsou ..... H01H 3/26 307/141

(Continued)

*Primary Examiner* — James Harvey

(74) *Attorney, Agent, or Firm* — Li & Cai Intellectual Property (USA) Office

(57) ABSTRACT

An automatic universal power socket includes a socket body, a socket unit, a rotating plate, and a motor. The socket body includes a socket panel having at least one through hole. The socket unit has a plurality of electrically conductive strips and a plurality of pin holes disposed therein, the pin holes being universal pin holes and corresponding to the electrically conductive strips. The rotating plate is rotatably disposed in front of the socket unit and has a plurality of socket holes, the socket holes being of different socket types and corresponding selectively to the at least one through hole and the plurality of pin holes. The motor is connected with the rotating plate for driving the rotating plate to rotate.

20 Claims, 20 Drawing Sheets

(56) References Cited

U.S. PATENT DOCUMENTS

| | | | | |
|---|---|---|---|---|
| 8,734,168 | B2 * | 5/2014 | Lee | H01R 31/06<br>439/171 |
| 2003/0196382 | A1 * | 10/2003 | Yokota | E05F 15/619<br>49/341 |
| 2008/0254684 | A1 * | 10/2008 | Tracy | G06F 1/1616<br>439/620.21 |
| 2012/0171902 | A1 * | 7/2012 | Lee | H01R 24/28<br>439/660 |

* cited by examiner

AUTOMATIC UNIVERSAL POWER SOCKET

FIELD OF THE INVENTION

The present disclosure relates to an automatic universal power socket, and more particularly to a universal power socket having various types of sockets for plugging to supply requisite power.

BACKGROUND OF THE INVENTION

Different types of sockets that are used in different countries can result in inconveniences for travelers. For instance, a common socket may be designed as a two or three-pin socket depending on national standards, with some of the two-pin sockets having flat, elongated pin holes, and some having round pin holes. This may easily render electronics devices of a traveler (e.g., chargers, laptop computers, shavers, etc.) useless due to differences between plug and socket types.

Therefore, different types of adapters have been developed to combat the inconveniences resulting from the abovementioned situation. However, these adapters generally only apply to a single type of plug and socket combination for conversion, so that all possible types of adapters need be brought along by a traveler planning on visiting more than one country, thereby still causing a significant level of inconvenience for the traveler.

SUMMARY OF THE INVENTION

The object of the present disclosure is to provide an automatic universal power socket that can alleviate the drawbacks associated with the prior art. The automatic universal power socket of the present disclosure provides various types of sockets for supplying power, and can be electrically driven to automatically shift to a required type of socket for plugging.

The automatic universal power socket of the present disclosure includes a socket body, a socket unit, a rotating plate, and a motor. The socket body includes a socket panel having at least one through hole. The socket unit has a plurality of electrically conductive strips and a plurality of pin holes disposed therein, the pin holes being universal pin holes and corresponding to the electrically conductive strips. The rotating plate is rotatably disposed in front of the socket unit and has a plurality of socket holes, the socket holes being of different socket types and corresponding selectively to the at least one through hole and the plurality of pin holes. The motor is connected with the rotating plate for driving the rotating plate to rotate.

To further understand the techniques, means and effects of the present disclosure, the following detailed descriptions and appended drawings are hereby referred to, such that, and through which, the purposes, features and aspects of the present disclosure can be thoroughly and concretely appreciated. However, the appended drawings are provided solely for reference and illustration, without any intention to limit the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Embodiments of a nebulizer according to the present disclosure are described herein. Other advantages and objectives of the present disclosure can be easily understood by one skilled in the art from the disclosure. The present disclosure can be applied in different embodiments. Various modifications and variations can be made to various details in the description for different applications without departing from the scope of the present disclosure. The drawings of the present disclosure are provided only for simple illustrations, but are not drawn to scale and do not reflect the actual relative dimensions. The following embodiments are provided to describe in detail the concept of the present disclosure, and are not intended to limit the scope thereof in any way.

First Embodiment

Figure 1:
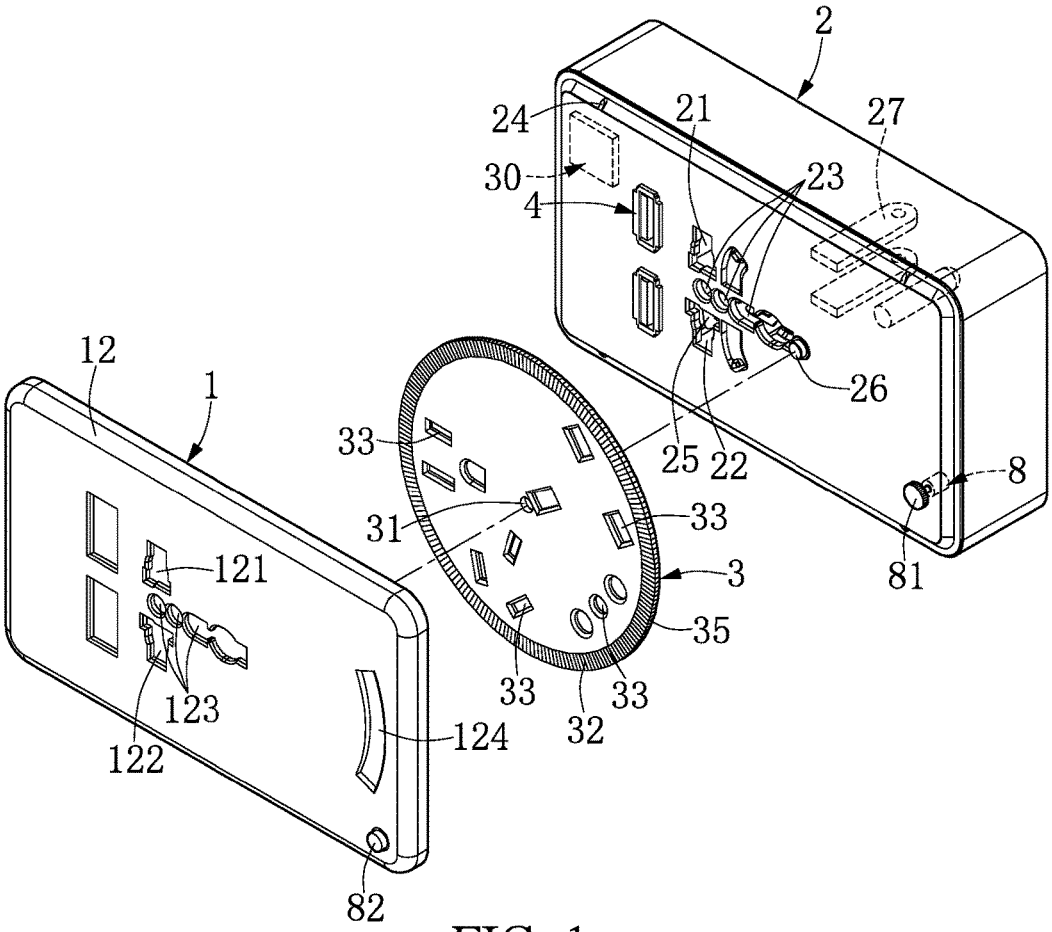
FIG. 1 is an exploded perspective view of an automatic universal power socket according to a first embodiment of the present disclosure.
Figure 2:
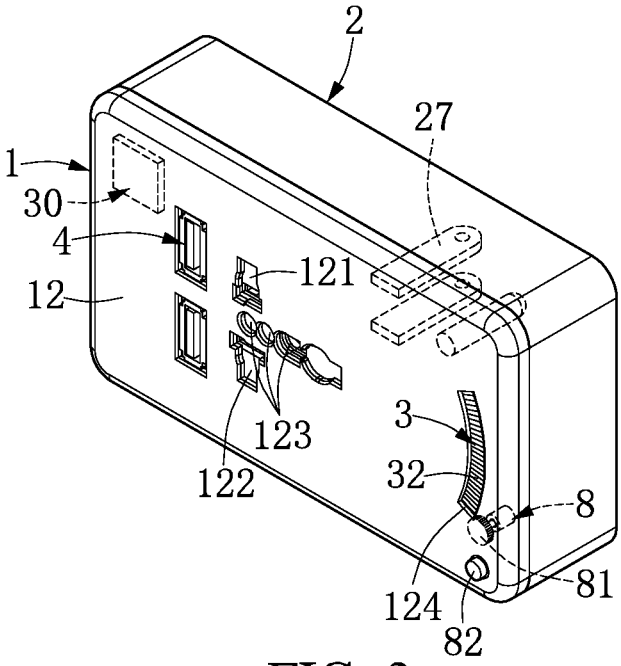
FIG. 2 is an assembled perspective view of the automatic universal power socket according to the first embodiment of the present disclosure.

Referring to FIGS. 1 and 2, an automatic (electronic) universal power socket according to the first embodiment of the present disclosure includes a socket body 1, a socket unit 2, a rotating plate 3, and a motor 8. The automatic universal power socket can be sockets on an adapter, a wall socket, sockets on an extension cord, or other socket configurations, and is not limited in the present disclosure.

The socket body 1 is made of an insulative material such as plastic, and may be a one-piece or multiple-piece structure, not being limited by the present disclosure and adaptable according to practical requirements. In this embodiment, the socket body 1 includes a socket panel 12 that may be square-shaped or in other shapes. The socket panel 12 has a plurality of through holes 121, 122, 123 that are universal in shape for allowing plug pins of different shapes and sizes to extend therethrough.

The socket body 1 can be disposed with at least one connector 4 being exposed from the front side of the socket body 1 (i.e., the socket panel 12) for being plugged with a corresponding connector. The connector may be a USB connector, an IEEE1394 connector, an HDMI connector, an AV terminal, a DC terminal, or various other types of electrical connectors.

The socket unit 2 can be disposed on the socket body 1, and in the present embodiment, the socket unit 2 is fixed to the socket panel 12 of the socket body 1 by a number of engaging blocks 24 disposed along the top and bottom edges of the socket unit 2, so that socket unit 2 can be fixingly engaged to the rear side of the socket body 1, and that the front side of the socket unit 2 is faced toward the socket panel 12.

The socket unit 2 is a universal socket module having a plurality of electrically conductive strips 25 disposed therein that can electrically connect with various types of plug pins. The electrically conductive strips 25 can electrically connect with a plug pin 27 that protrudes from the rear side of the socket unit 2 and that plugs into a socket for supplying power to the electrically conductive strips 25.

The front side of the socket unit 2 facing toward the socket panel 12 has a plurality of pin holes 21, 22, 23. The pin holes 21, 22, 23 respectively correspond to the through holes 121, 122, 123. The pin holes 23 are located at a center position of the socket unit 2, and are generally grounding pin holes. The pin holes 21, 22 are generally power pin holes, but the configurations thereof are not limited in the embodiment. The pin holes 12, 22, 23 can be plugged with straightly or obliquely arrayed plug pins that are flat or round-shaped. The pin holes 21, 22, 23 are universal pin holes, and correspond to the electrically conductive strips 25 disposed in the socket unit 2 for facilitating electrical connection therewith by the insertion of plug pins. A pivot 26 can be protrudingly disposed on the front side of the socket unit 2 so as to allow the rotatable plate to be pivotally disposed thereon.

The rotating plate 3 can be circular or polygonal in shape, and is rotatably disposed in front of the socket unit 2 between the socket body 1 and socket unit 2 in this embodiment. The rotating plate 3 is rotatably disposed on the front side of the socket unit 2, and in this embodiment, the rotating plate 3 has a pivot hole 31 disposed in the center thereof that is pivotally connected with the pivot 26 for allowing the rotating plate 3 to be rotatably and pivotally disposed on the socket unit 2. The present disclosure, however, does not limit the manner of pivotal connection between the rotating plate 3 and the socket unit 2. For instance, a pivot may also be disposed on the rotating plate 3, with a pivot hole being disposed on the socket unit 2, as long as the rotating plate 3 can rotate relative to the socket unit 2.

The rotating plate 3 can be disposed between the socket body 1 (i.e., the socket panel 12) and the socket unit 2. In this embodiment, an arc-shaped slot 124 can be disposed in the socket panel 12, and a dialing part 32 can be disposed on the rotating plate 3. The dialing part 32 is disposed on the front side of the rotating plate 3 and is annular in shape, and may be formed with anti-slip textures. The slot 124 and the dialing part 32 are co-axially and correspondingly disposed, so that the dialing part 32 can be exposed from the socket panel 12 through the slot 124. The width of the slot 124 can be greater than the width of the dialing part, but the present disclosure is not limited in this aspect. A user may dial and rotate the rotating plate 3 via the dialing part 32 with his/her finger, so that the rotating plate 3 can also be manually rotated. In this embodiment, the user can conveniently control the rotation of the rotating plate 3 from the front side of the socket panel 12 of the socket body 1. However, the slot 124 and the dialing part 32 can also be omitted from other embodiments of the present disclosure, such that the rotating plate 3 can only be electrically driven by the motor 8 to rotate.

A plurality of socket holes 33 are disposed on the rotating plate 3 and are spaced apart from each other. Each set of the socket holes 33 can be of different socket types, such as a one-pin socket, a two-pin socket, or a three-pin socket, can include flat, elongated pin holes or round pin holes, and can comply with socket standards across Taiwan (R.O.C.), China, Italy, the United States, Australia, and Europe, not being limited by those disclosed in the present disclosure.

The motor 8 can be disposed on the socket body 1 or the socket unit 2. In this embodiment, the motor 8 is disposed on the inside of the socket unit 2. The motor 8 is electrically connected to a circuit unit 30, and the rotating plate 3 is connected to the motor 8, so that the rotating plate 3 can be electronically (i.e., automatically) driven to rotate. The structural relationship between the rotating plate 3 and the motor 8 is not limited in the present disclosure. In the present embodiment, the motor 8 (i.e., the power take-off shaft of the motor 8) is connected to a first gear 81, and a second gear 35 is disposed around the outer edge of the rotating plate 3, such that the first gear 81 and the second gear 35 mesh with each other to connect the rotating plate 3 with the motor 8. Furthermore, the rotating plate 3 can also be connected with the motor 8 via belts or other conventional transmission mechanisms, so as to allow the motor 8 to drive electronic rotation of the rotating plate 3.

The present disclosure can further include a control switch 82 electrically connected with the motor 8. The control switch 82 can be disposed on the socket body 1 or other appropriate positions, and can control the motor 8 to drive the rotation of the rotating plate 3. The motor 8 can drive the rotating plate 3 to rotate to a predetermined angle, so that the socket holes 33 of the rotating plate 3 can sequentially correspond in position to the pin holes 21, 22, 23 of the socket unit 2. The control switch 82 can also cut off the power of the motor 8 to allow for the manual dialing operation of the rotating plate 3. Furthermore, the present disclosure can also provide a switch for separating the first gear 81 and the second gear 35, so as to disconnect the electronic rotation mechanism of the present disclosure and allow for the manual dialing operation of the rotating plate 3.

The user can rotate the rotating plate 3 so that a required type of socket holes 33 correspond in position to the pin holes 21, 22, 23 of the socket unit 2, such that a plug of an electronic device can be plugged into the corresponding socket holes 33 and pin holes 21, 22, 23 via the plurality of through holes 121, 122, 123. The plug pins of the plug of the electronic device can thereby be electrically connected with the electrically conductive strips of the socket unit 2, so that power can be transmitted to the electronic device.

When using a different type of plug of a different electronic device, the user can rotate again the rotating plate 3 so that another type of socket holes 33 correspond in position to the pin holes 21, 22, 23, such that the plug of the electronic device can be plugged into the corresponding socket holes 33 and pin holes 21, 22, 23 via the plurality of through holes 121, 122, 123. The plug pins of the plug of the electronic device can thereby be electrically connected with the electrically conductive strips of the socket unit 2, so that power can be transmitted to the electronic device.

Second Embodiment

Figure 3:
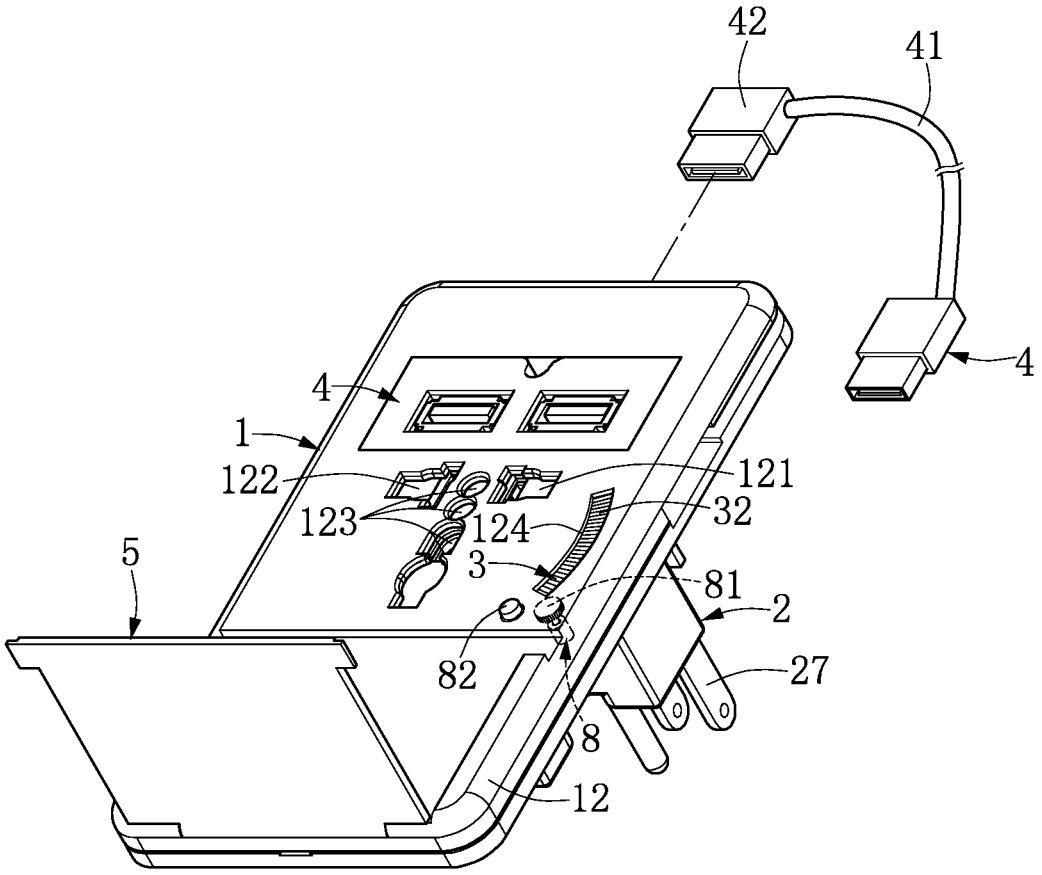
FIG. 3 is an assembled perspective view of the automatic universal power socket according to a second embodiment of the present disclosure.

Referring to FIG. 3, the automatic universal power socket according to the second embodiment of the present disclosure further includes a mounting panel 5 pivotally disposed on the front side of the socket panel 12 of the socket body 1, so that the mounting panel 5 can be swiveled downward to a horizontal position for placing an electronic device thereon, or swiveled upward to be stacked against the front side of the socket panel 12. A connector 4 is movably disposed on the socket body 1 of the present embodiment, and connects to an end of a cable 41. The other end of the cable 41 is connected to a plug 42 being plugged into the socket panel 12 of the socket body 1 so as to establish electrical connection with, e.g., computers or other electronic devices.

Third Embodiment

Figure 4:
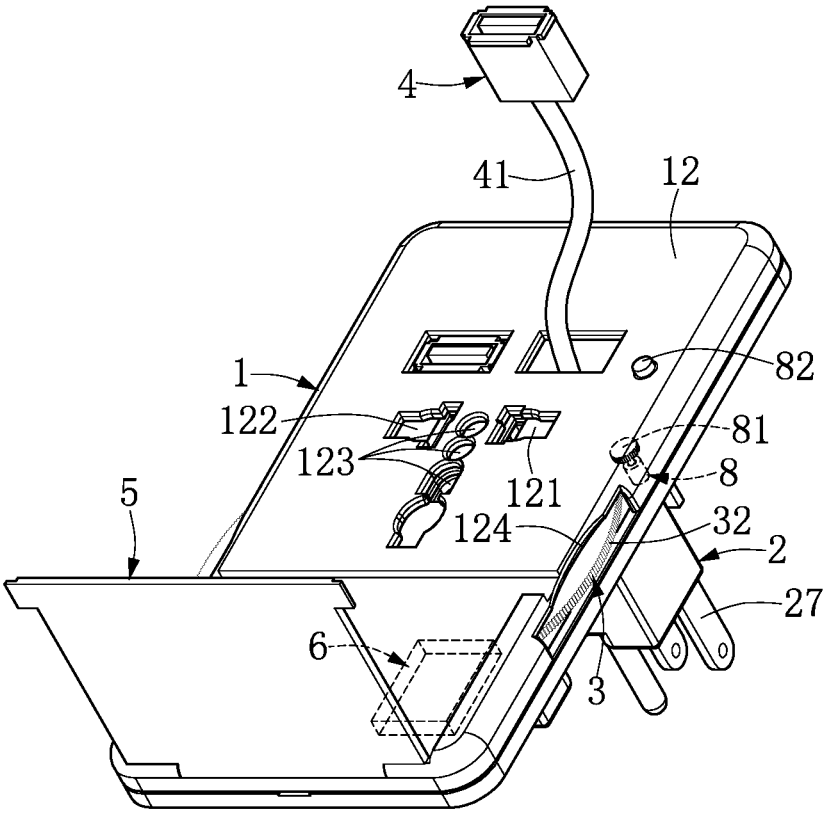
FIG. 4 is an assembled perspective view of the automatic universal power socket according to a third embodiment of the present disclosure.

Referring to FIG. 4, the automatic universal power socket according to the third embodiment of the present disclosure further includes a wireless charger emitter 6 disposed at an appropriate position on the socket body 1 or the mounting panel 5. The wireless charger emitter 6 can be electrically connected to a circuit unit or a computer (not shown in the figures) in a wired manner. With the wireless charger emitter 6 disposed on the socket body 1, when an electronic device with a wireless charger receiver (not shown in the figures) is placed on the mounting panel, the wireless charger emitter 6 and the wireless charger emitter can transfer energy via a wireless transmission protocol to non-contactly charge the electronic device in a wireless manner. A connector 4 is movably disposed on the socket body 1 and is connected to an end of a cable 41. The other end of the cable 41 extends into the socket panel 12 of the socket body 1 to electrically connect with computers or other electronic devices. The connector 4 and the cable 41 can be stretched out of the socket body 1 for convenient use.

In this embodiment, the dialing part 32 is disposed around the outer edge of the rotating plate 3, and the slot 124 is disposed on a side edge of the socket panel 12, such that the dialing part 32 is exposed from the socket panel 12 through the slot 124 to allow the user to rotate the rotating plate 3 with his/her finger via the dialing part 32. In addition, the dialing part 32 of this embodiment can be a gear that meshes with the first gear 81 so that the rotating plate 3 can be connected to the motor 8 via the dialing part 32 and the first gear 81 to electronically drive the rotating plate 3 to rotate.

Fourth Embodiment

Figure 5:
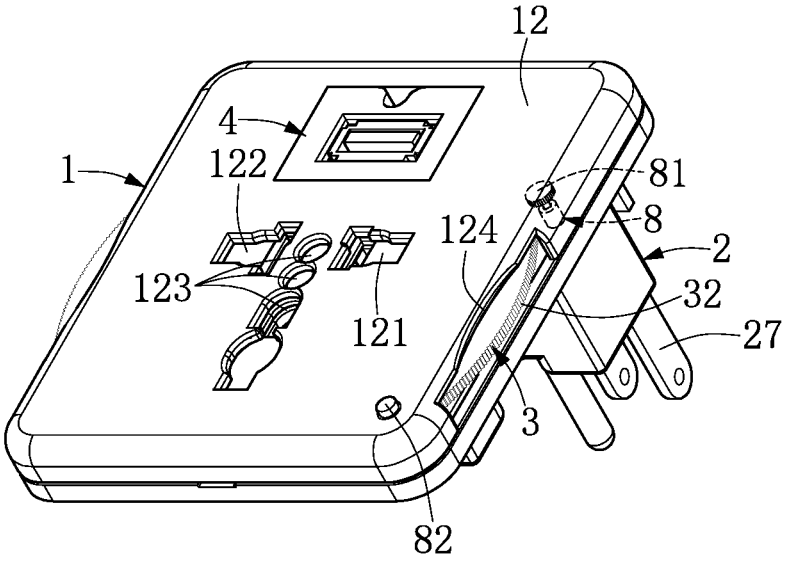
FIG. 5 is an assembled perspective view of the automatic universal power socket according to a fourth embodiment of the present disclosure.

Referring to FIG. 5, it should be noted that the type, shape, and structure of the automatic universal power socket of the present disclosure may be varied according to different requirements. In this embodiment, the connector 4 has a modular design, in which the connector 4 is detachably disposed on the socket body 1. The dialing part 32 is disposed around the outer edge of the rotating plate 3 and can be a gear that meshes with the first gear 81, so that the rotating plate 3 can be connected to the motor 8 via the dialing part 32 and the first gear 81 to electronically drive the rotating plate 3 to rotate.

Fifth Embodiment

Figure 6:
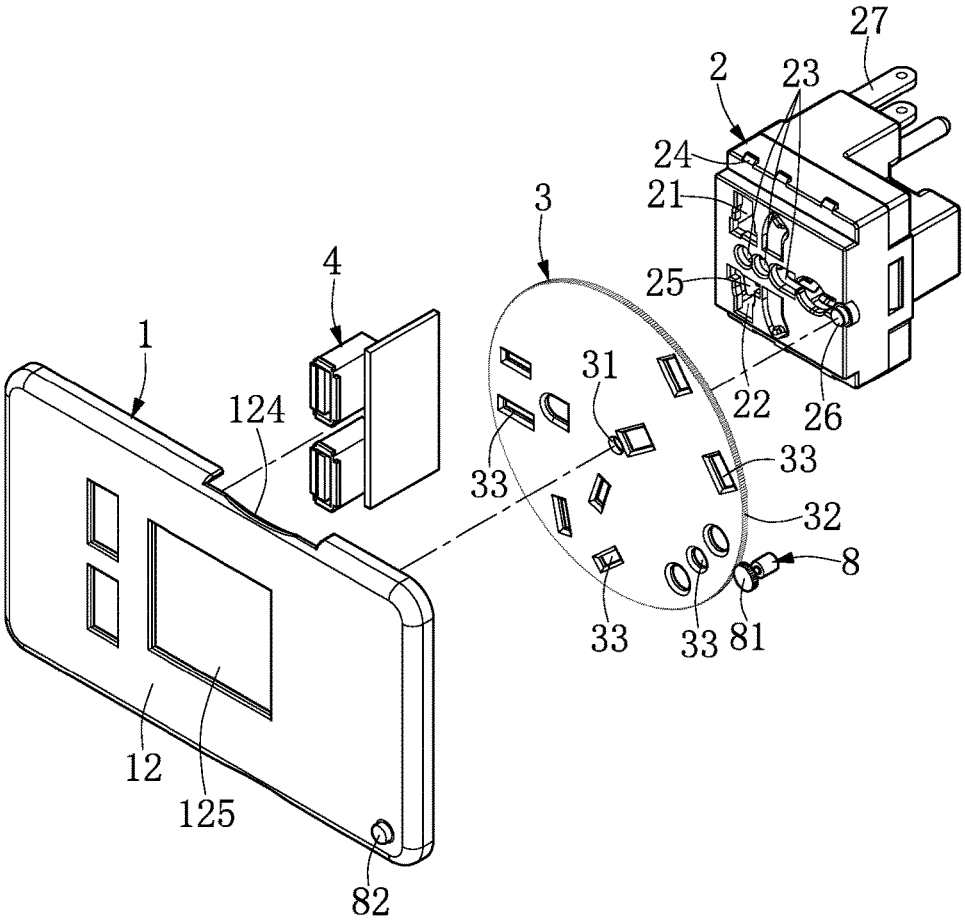
FIG. 6 is an exploded perspective view of the automatic universal power socket according to a fifth embodiment of the present disclosure.

Referring to FIG. 6, the socket panel 12 of the socket body 1 has a large through hole 125 that is square-shaped or that may be in other shapes. The through hole 125 of the present embodiment can replace the through holes 121, 122, 123 mentioned in previous embodiments and has an area that can encompass that of the pin holes 21, 22, 23 and that can expose the pin holes 21, 22, 23 from the socket panel 12. The socket holes 33 on the rotating plate 3 can selectively correspond to the through hole 125 and the pin holes 21, 22, 23. In this embodiment, the dialing part 32 is disposed around the outer edge of the rotating plate 3 and can be a gear that meshes with the first gear 81 so that the rotating plate 3 can be connected to the motor 8 via the dialing part 32 and the first gear 81 to electronically drive the rotating plate 3 to rotate.

Sixth Embodiment

Figure 7:
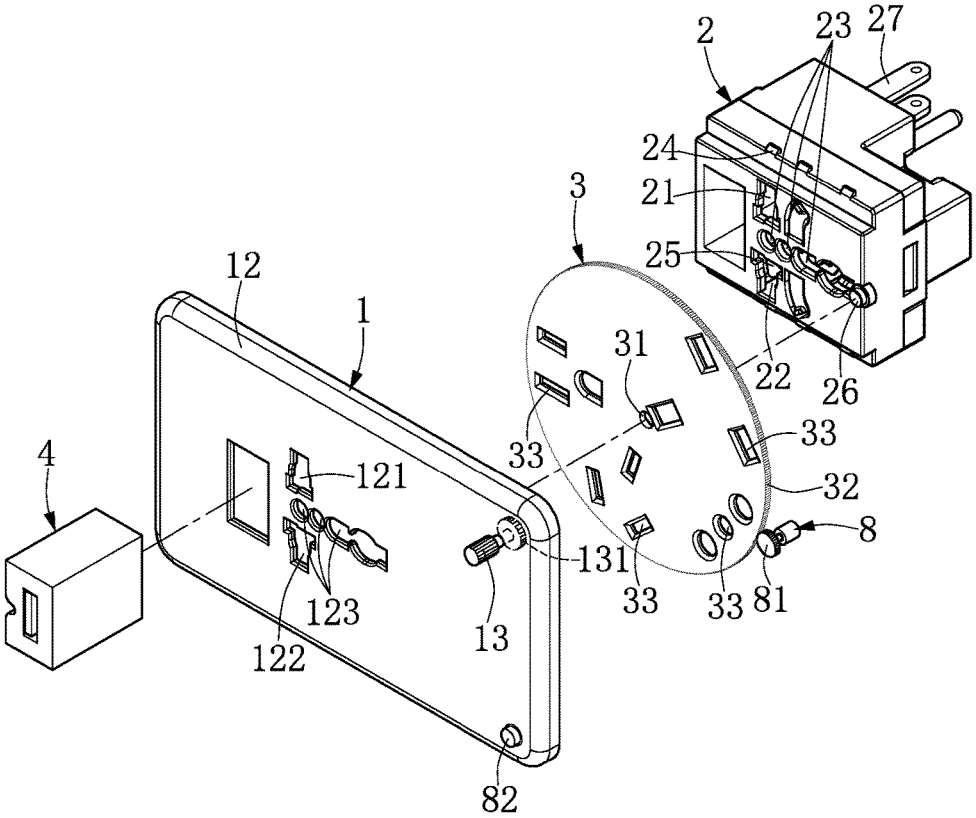
FIG. 7 is an exploded perspective view of the automatic universal power socket according to a sixth embodiment of the present disclosure.

Referring to FIG. 7, in this embodiment, the connector 4 has a modular design and is detachably disposed on the socket body 1 and the socket unit 2. Furthermore, a turn knob 13 is pivotally and rotatably disposed on the socket panel 12 of the socket body 1, and protrudes from the front side of the socket panel 12. One end of the turn knob 13 passes into the inside of the socket panel 12, one end of the turn knob is disposed with a transmission gear 131 that meshes with the dialing part 32 disposed around the outer edge of the rotating plate 3. Therefore, the transmission gear 131 can drive the rotation of the dialing part 32 and the rotating plate 3 so that the user can conveniently control the rotation of the rotating plate 3 from the front side of the socket panel 12 of the socket body 1.

Seventh Embodiment

Figure 8:
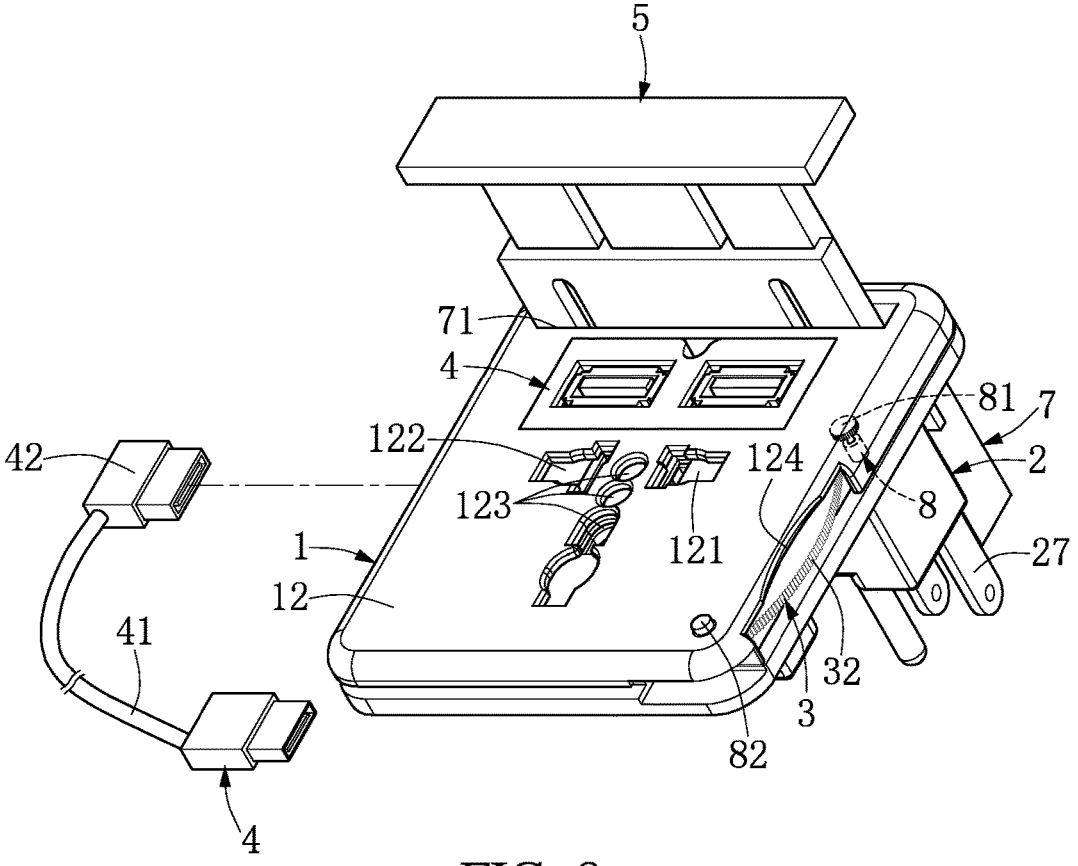
FIG. 8 is an assembled perspective view of the automatic universal power socket according to a seventh embodiment of the present disclosure.

Referring to FIG. 8, an automatic universal power socket according to a seventh embodiment of the present disclosure further includes an accommodating box 7 disposed on the rear side of the socket body 1. The front side of the accommodating box 7 has an opening 71, and the mounting panel 5 is disposed in the accommodating box 7, such that the mounting panel 5 can slide back and forth through the opening 71. The mounting panel 5 in this embodiment can be pulled out along the opening 71 for being placed with an electronic device.

Eighth-Ninth Embodiments

Figure 9:
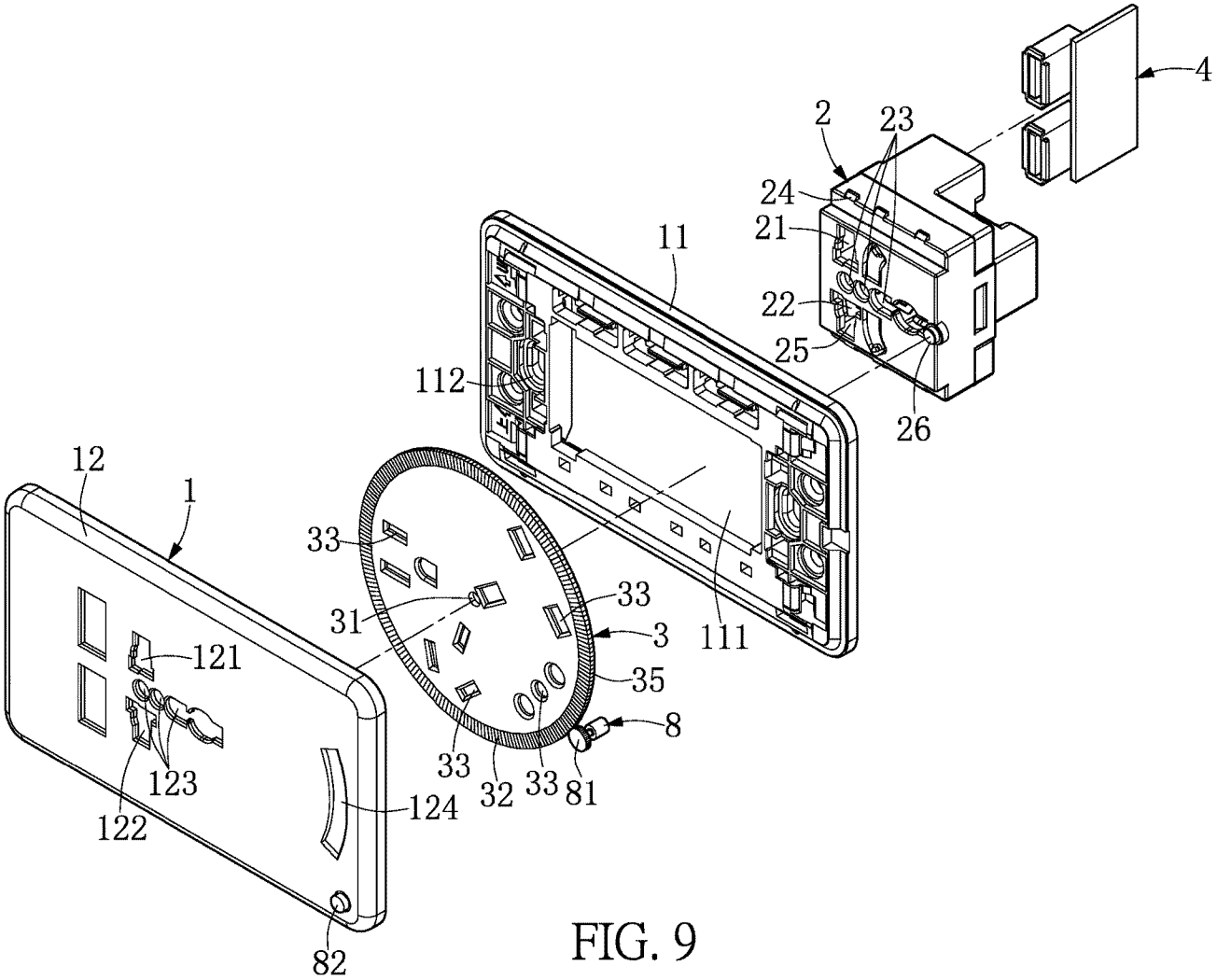
FIG. 9 is an exploded perspective view of the automatic universal power socket according to an eight embodiment of the present disclosure.
Figure 10:
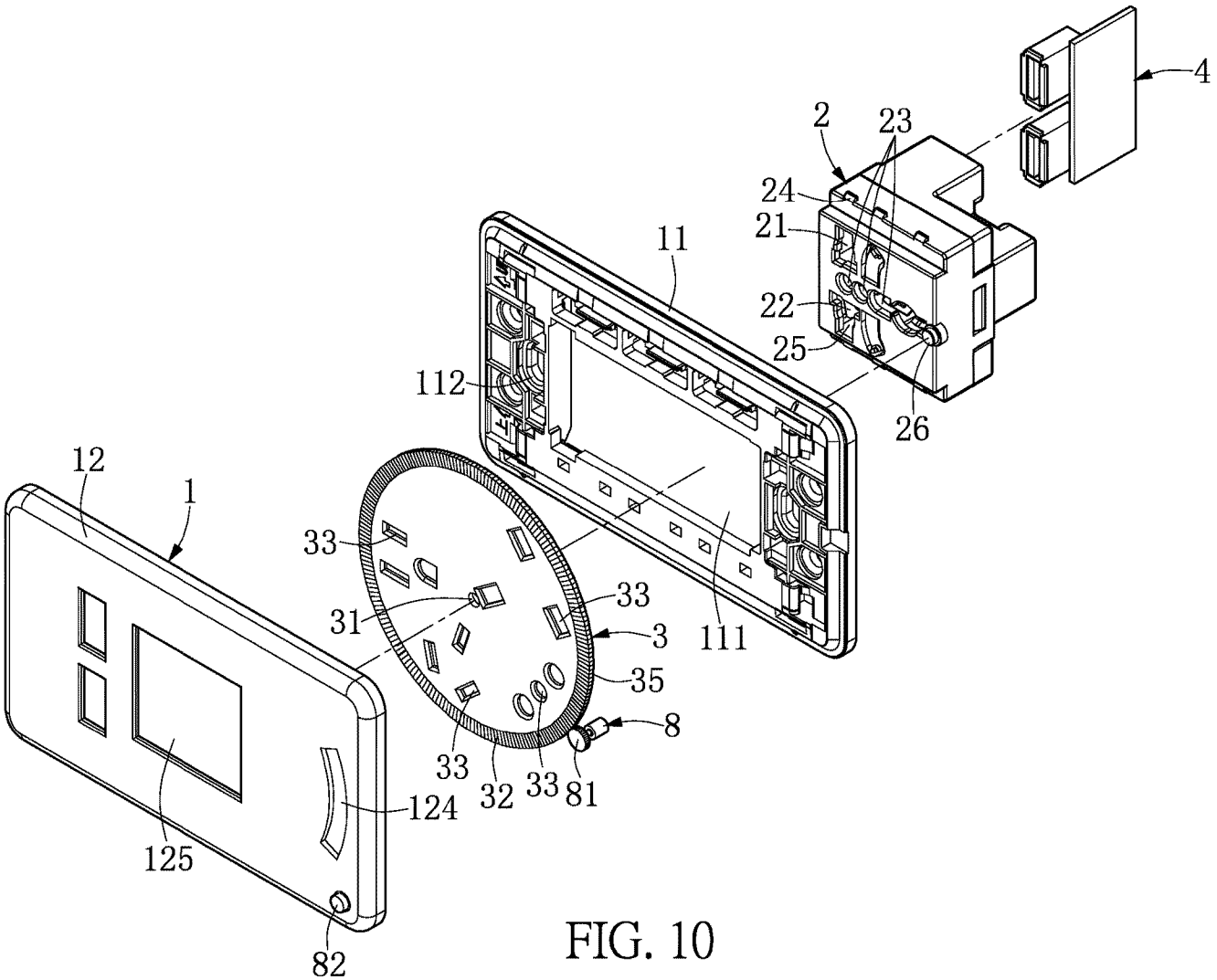
FIG. 10 is an exploded perspective view of the automatic universal power socket according to a ninth embodiment of the present disclosure.

Referring to FIGS. 9 and 10, the automatic universal power socket of these embodiments is configured as a wall socket. The socket body 1 of the present embodiments includes a socket base 11 and a socket panel 12. The socket panel 12 is disposed on the front side of the socket base 11, and can be fixed thereon by fastening or threaded engagement. An accommodating groove 111 is defined along the middle of the socket base 11 for being disposed with the socket unit 2, and the two sides of the socket base 11 can have fixing holes 112 for allowing the automatic universal power socket to be screwed into a wall. The socket unit 2 of the present embodiment is fixed to the socket base 11 of the socket body 1 in the accommodating groove 111 by a number of engaging blocks 24 disposed along the top and bottom edges of the socket unit 2, so that the front side of the socket unit 2 faces toward the socket panel 12. In this embodiment, the plug pins 27 of the previous embodiments are omitted, and the electrically conductive strips 25 can be electrically connected to power cables (not shown in the figures) by plugging or welding for power.

The rotating plate 3 can be disposed between the socket base 11 and the socket panel 12 of the socket body 1, so that the rotating plate 3 is also disposed between the socket body 1 and the socket unit 2. In this embodiment, the dialing part 32 is disposed on the front side of the rotating plate 3, and the slot 124 is disposed on the socket panel 12 to expose a portion of the dialing part 32 from the socket panel 12, so that the user can rotate the rotating plate 3 with his/her finger via the dialing part 32. The motor 8 of this embodiment is connected to a first gear 81, and the rotating plate 3 has a second gear 35 disposed around the outer edge of the rotating plate 3. The first gear 81 and the second gear 35 mesh with each other and allow the rotating plate 3 to be connected to the motor 8.

Tenth Embodiment

Figure 11:
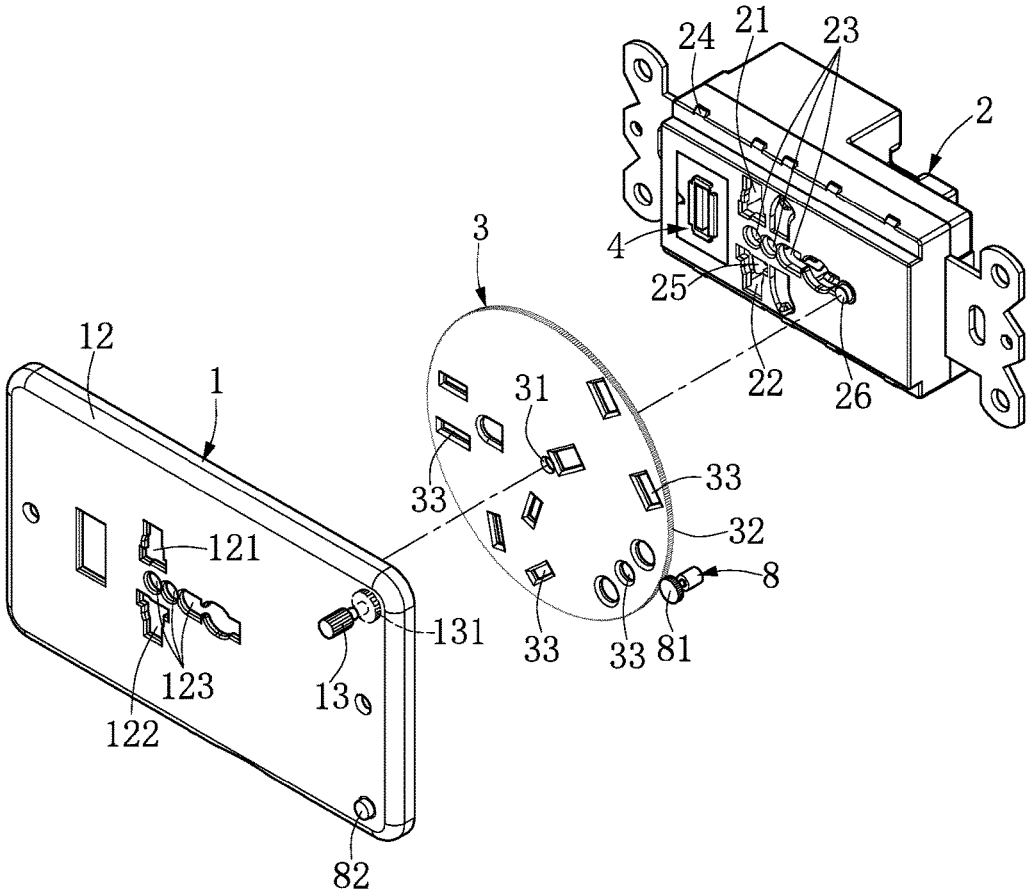
FIG. 11 is an exploded perspective view of the automatic universal power socket according to a tenth embodiment of the present disclosure.

Referring to FIG. 11, the socket unit 2 of this embodiment is configured to be of a type conforming to socket standards in the United States. The socket body 1 of this embodiment includes a socket panel 12, and does not include the socket base 11. The rotating plate 3 is disposed between the socket panel 12 of the socket body 1 and the socket unit 2.

Eleventh-Thirteenth Embodiments

Figure 12:
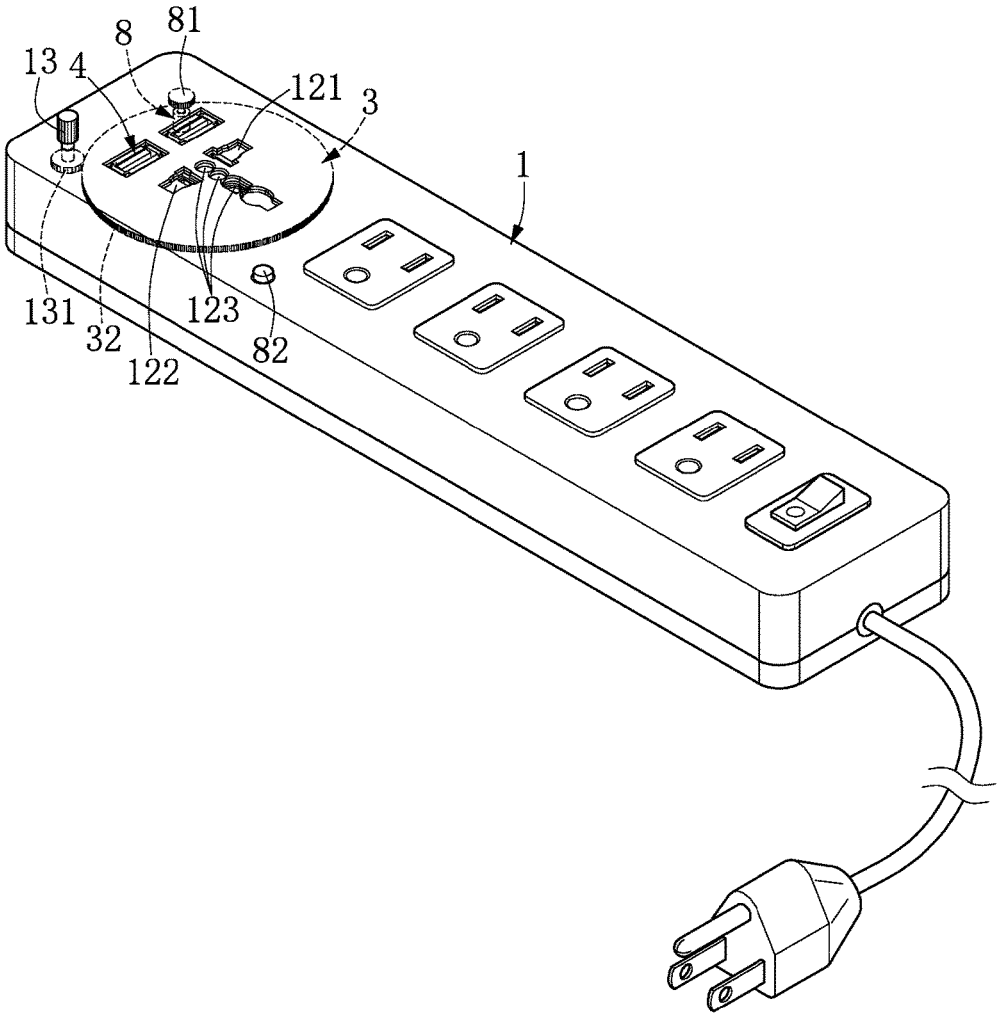
FIG. 12 is an assembled perspective view of the automatic universal power socket according to a eleventh embodiment of the present disclosure.
Figure 13:
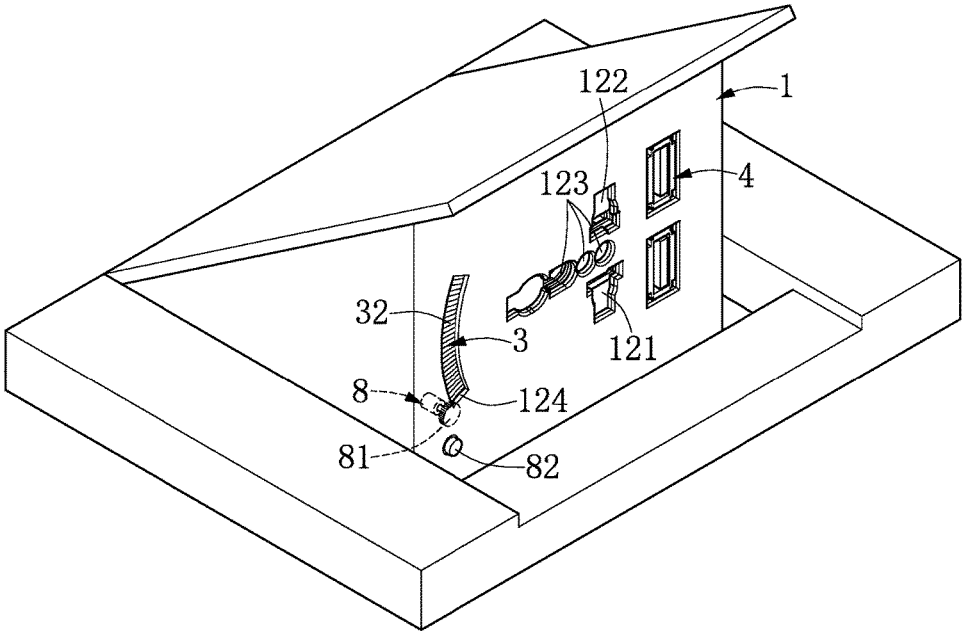
FIG. 13 is an assembled perspective view of the automatic universal power socket according to a twelfth embodiment of the present disclosure.
Figure 14:
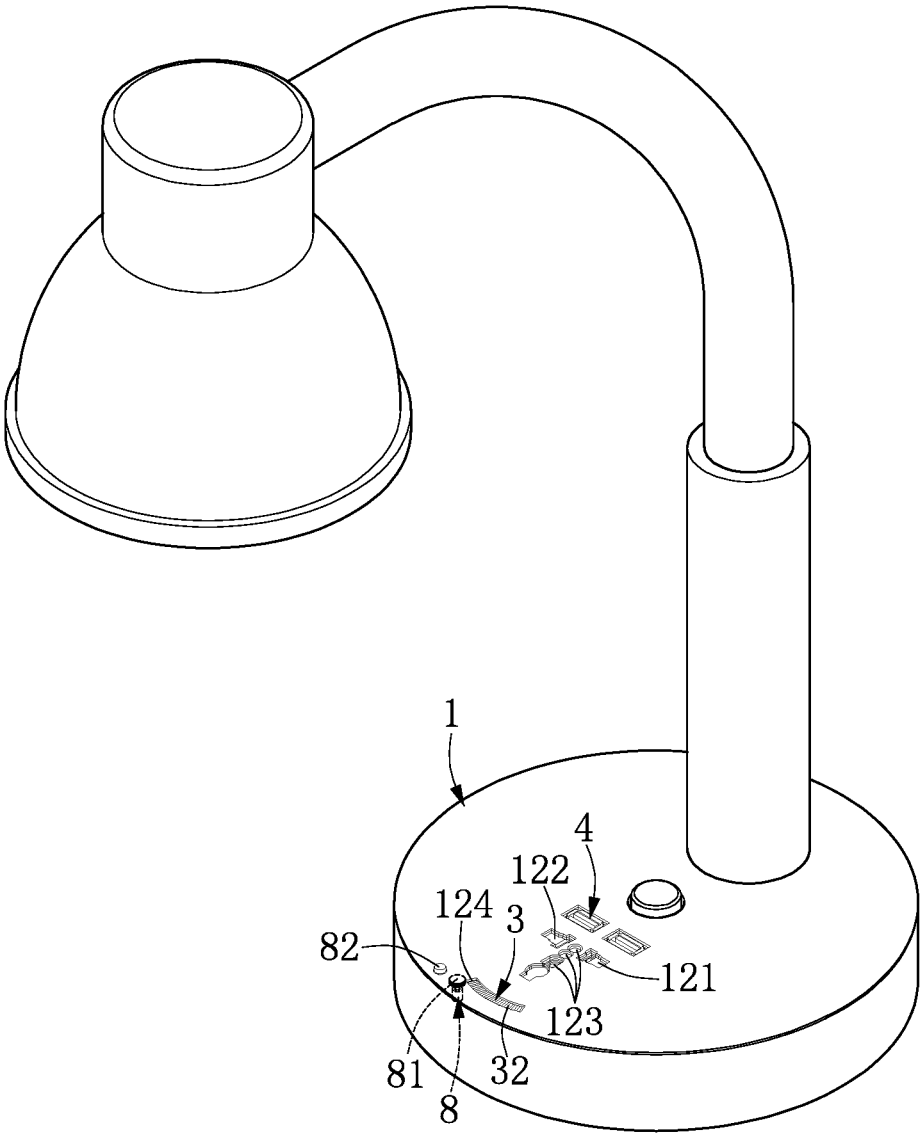
FIG. 14 is an assembled perspective view of the automatic universal power socket according to a thirteenth embodiment of the present disclosure.

Referring to FIG. 12, the automatic universal power socket of these embodiments is configured as extension cord sockets. As shown in FIG. 13, the automatic universal power socket can be disposed on a tabletop or the ground. As shown in FIG. 14, the automatic universal power socket can be disposed in a lamp.

Fourteenth Embodiment

Figure 15:
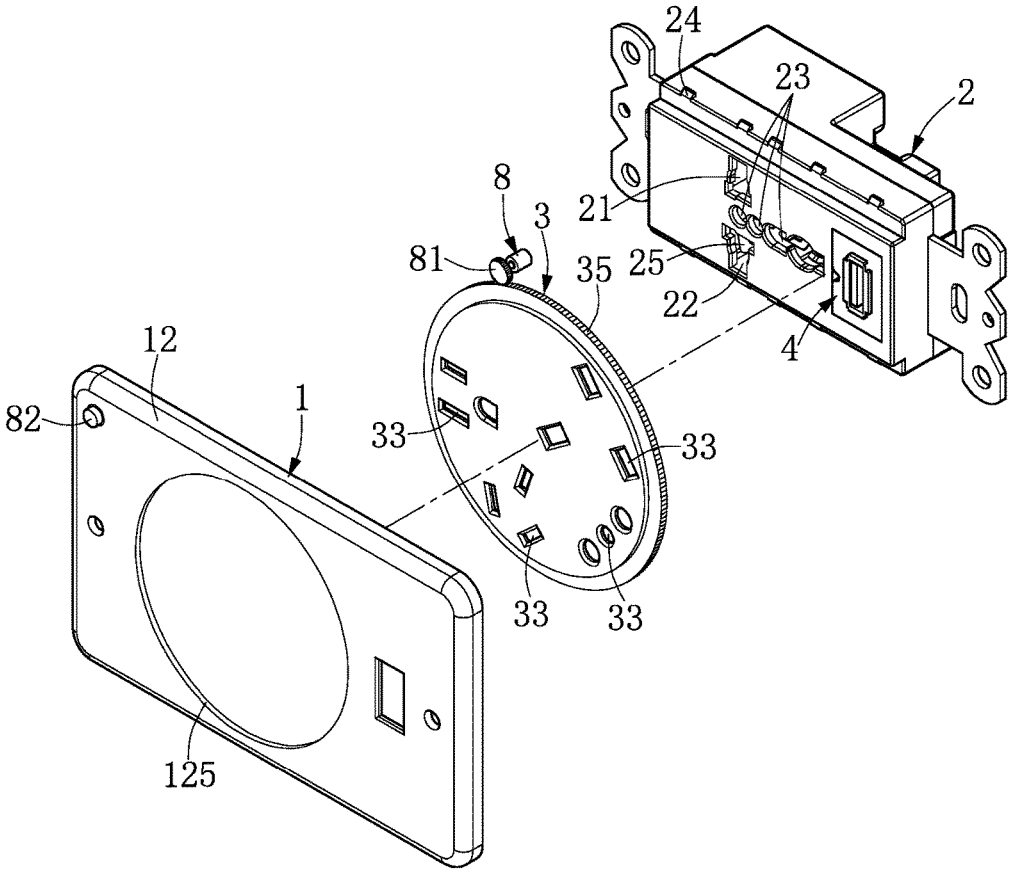
FIG. 15 is an exploded perspective view of the automatic universal power socket according to a fourteenth embodiment of the present disclosure.

Referring to FIG. 15, in this embodiment, the socket panel 12 of the socket body 1 has a large through hole 125 that is circle-shaped. The through hole 125 of the present embodiment can replace the through holes 121, 122, 123 mentioned in previous embodiments and has an area that can encompass that of the pin holes 21, 22, 23 and that can expose the pin holes 21, 22, 23 from the socket panel 12. In addition, the rotating plate 3 can be pivotally disposed on the socket panel 12, and the socket holes 33 can selectively correspond to the pin holes 21, 22, 23.

Fifteenth Embodiment

Figure 16:
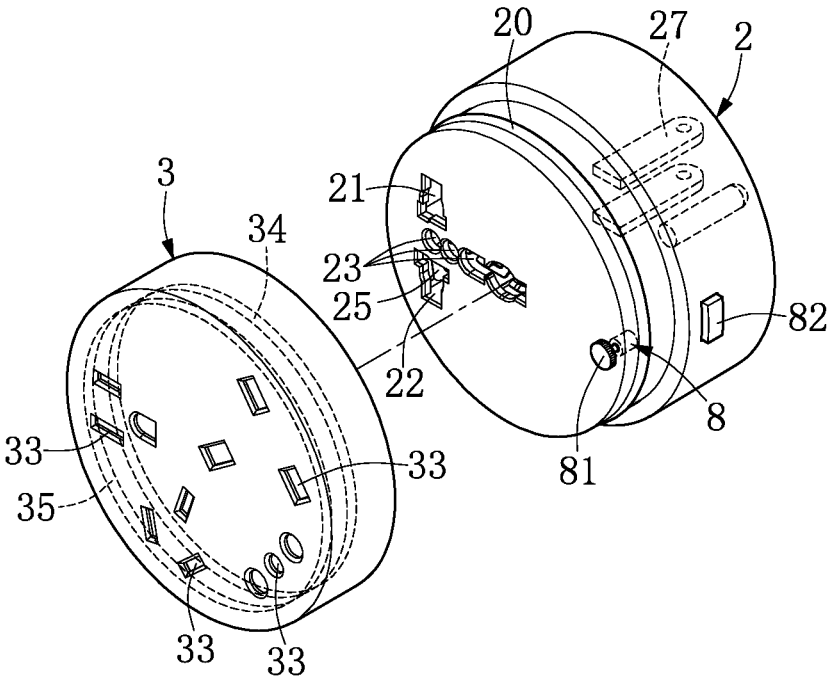
FIG. 16 is an exploded perspective view of the automatic universal power socket according to a fifteenth embodiment of the present disclosure.

Referring to FIG. 16, it can be seen that the socket body 1 is omitted from this embodiment. The socket unit 2 has a plurality of electrically conductive strips 25 and a plurality of pin holes 21, 22, 23 disposed therein, the pin holes 21, 22, 23 being universal pin holes and corresponding to the electrically conductive strips 25. The rotating plate 3 is rotatably disposed on the socket unit 2 and has a plurality of socket holes 33, the socket holes 33 being of socket different types and corresponding selectively to the plurality of pin holes 21, 22, 23. In this embodiment, the rotating plate 3 is a circular hollow body and is sleeved on a cylindrical structure of the socket unit 2 such that the rotating plate 3 can move freely. The inner edge of the rotating plate 3 has an annular first fixing portion 34 (e.g., a protruding ring), and the outer edge of the socket unit 2 has an annular second fixing portion 20 (e.g., an annular groove), and the first and second fixing portions 34, 20 cooperate with each other to fix the rotating plate 3 on the socket unit 2.

Sixteenth Embodiment

Figure 17:
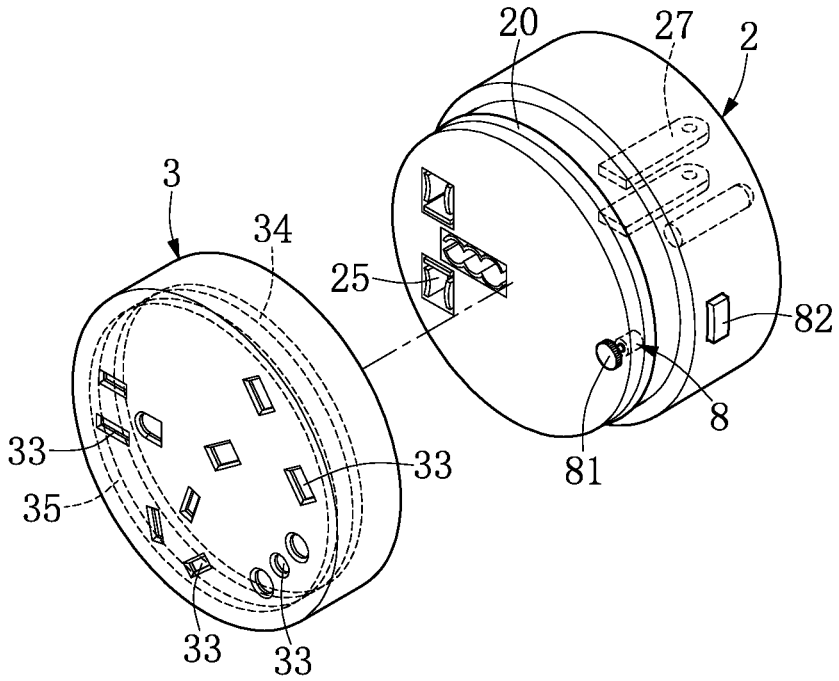
FIG. 17 is an exploded perspective view of the automatic universal power socket according to a sixteenth embodiment of the present disclosure.

Referring to FIG. 17, the socket unit 2 of this embodiment has a plurality of electrically conductive strips 25 that are exposed from a front side of the socket unit 2. The rotating plate 3 is rotatably disposed on the socket unit 2, and is disposed with a plurality of socket holes 33 that are of different socket types and that selectively correspond to the electrically conductive strips 25.

Seventeenth Embodiment

Figure 18:
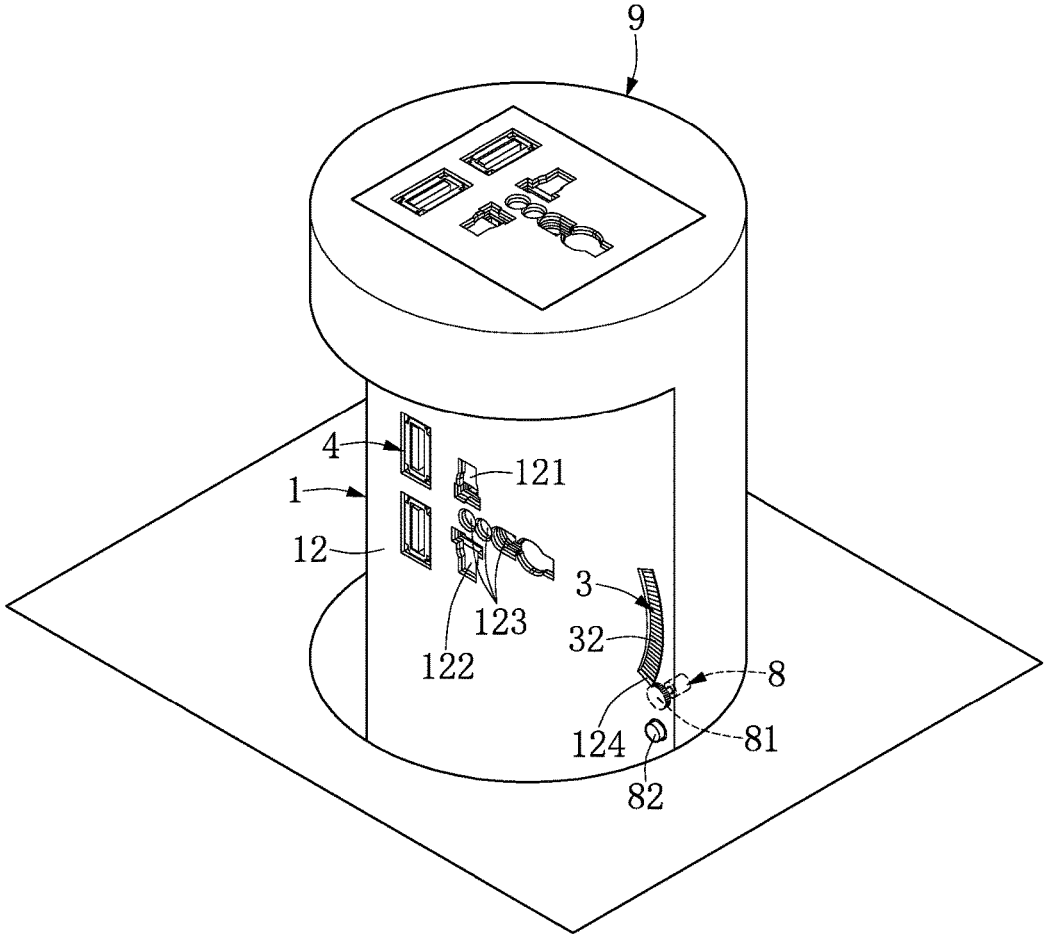
FIG. 18 is an assembled perspective view of the automatic universal power socket according to a seventeenth embodiment of the present disclosure.

Referring to FIG. 18, the automatic universal power socket according to this embodiment of the present disclosure further includes a lift structure 9 that can be disposed on a tabletop or a device and that can ascend or descend thereon.

Eighteenth-Nineteenth Embodiments

Figure 19:
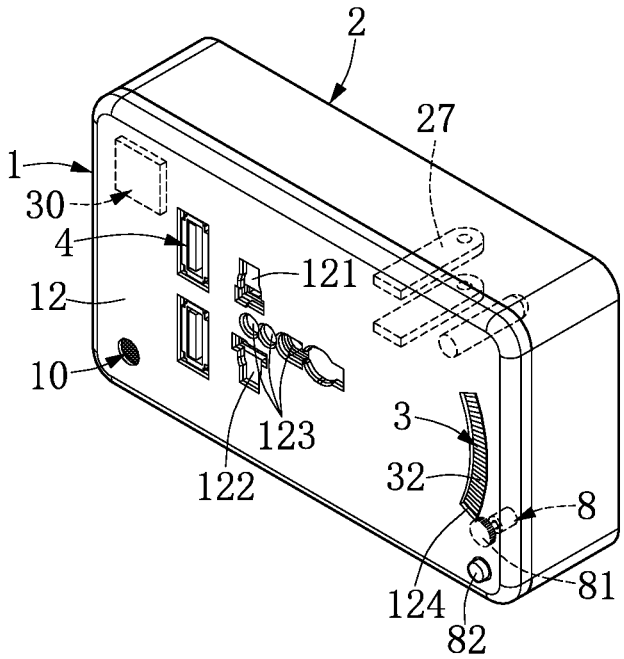
FIG. 19 is an assembled perspective view of the automatic universal power socket according to an eighteenth embodiment of the present disclosure.
Figure 20:
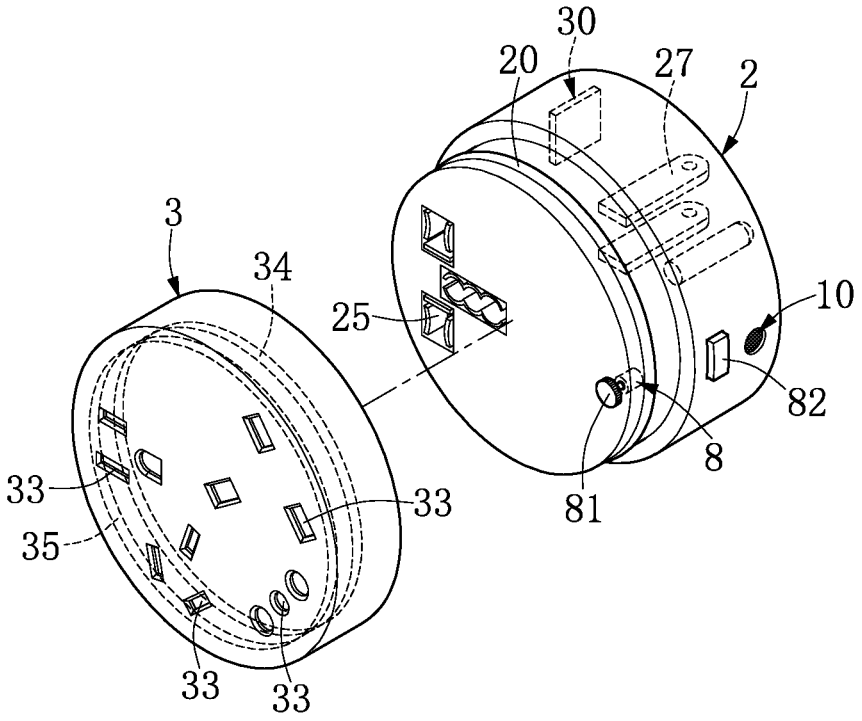
FIG. 20 is an exploded perspective view of the automatic universal power socket according to a nineteenth embodiment of the present disclosure.

Referring to FIGS. 19 and 20, the automatic universal power socket of these embodiments can further include a sound receiver 10, which can be such as a microphone. The sound receiver 10 is electrically connected to the circuit unit 30, and can be electrically connected to the motor 8 via the circuit unit 30. The sound receiver 10 is configured to receive voice commands to control the motor to drive the rotation of the rotating plate. In another embodiment of the present disclosure, the motor 8 can also be controlled by hand gestures to drive the rotation of the rotating plate 3, so that a motion sensor (not shown in the figures) is further disposed on the socket body 1 or the socket unit 2. The motion sensor can be an image capturing device that can capture images of the hand movements of the user so as to allow the user to control the rotation of the rotating plate 3 with hand gestures.

The aforementioned descriptions merely represent the preferred embodiments of the present disclosure, without any intention to limit the scope of the present disclosure which is fully described only within the following claims. Various equivalent changes, alterations or modifications based on the claims of the present disclosure are all, consequently, viewed as being embraced by the scope of the present disclosure.

What is claimed is:

1. An automatic universal power socket comprising:

a socket body including a socket panel, the socket panel having at least one through hole;

a socket unit having a plurality of electrically conductive strips and a plurality of pin holes disposed therein, the pin holes being universal pin holes and corresponding to the electrically conductive strips;

a rotating plate rotatably disposed in front of the socket unit and having a plurality of socket holes, the socket holes being of different socket types and corresponding selectively to the at least one through hole and the plurality of pin holes; and a motor connected with the rotating plate for driving the rotating plate to rotate.

2. The automatic universal power socket according to claim 1, wherein the motor is electrically connected to a control switch, the control switch controlling to the motor to drive the rotation of the rotating plate, or cutting off the power of the motor.

3. The automatic universal power socket according to claim 1, wherein the motor is connected to a first gear, the rotating plate has a second gear, and the first and second gears mesh with each other.

4. The automatic universal power socket according to claim 1, wherein a turn knob is pivotally disposed on and protrudes from the front side of the socket panel, one end of the turn knob passes into the inside of the socket panel, one end of the turn knob is disposed with a transmission gear, a dialing part is disposed around the outer edge of the rotating plate, and the transmission gear and the dialing part of the rotating plate mesh with each other.

5. The automatic universal power socket according to claim 1, wherein a slot is disposed in the socket panel, a dialing part is disposed on the front side of the rotating plate and is annular in shape, and the dialing part is exposed from the socket panel through the slot.

6. The automatic universal power socket according to claim 1, wherein a slot is disposed at a side edge of the socket panel, a dialing part is disposed around the outer edge of the rotating plate, the dialing part is exposed from the socket panel through the slot, the motor is connected to a first gear, the dialing part is a gear, and the dialing part meshes with the first gear.

7. The automatic universal power socket according to claim 1, wherein the socket body further incudes a socket base, the rotating plate is disposed between the socket base and the socket panel, the socket base defines an accommodating groove, and the socket unit is disposed in the accommodating groove.

8. The automatic universal power socket according to claim 1, further comprising a mounting panel pivotally disposed on the front side of the socket panel for being stacked against the front side of the socket panel or being swiveled to a horizontal position.

9. The automatic universal power socket according to claim 1, further comprising an accommodating box disposed on the rear side of the socket body, the front side of the accommodating box having an opening, the accommodating box having a mounting panel disposed therein, and the mounting panel being slidable back and forth through the opening.

10. The automatic universal power socket according to claim 1, wherein the plurality of pin holes are exposed from the socket panel through the at least one through hole, and the rotating plate is pivotally disposed on the socket panel.

11. The automatic universal power socket according to claim 1, wherein the electrically conductive strips are electrically connected to a plug pin, and the plug pin protrudes from the rear side of the socket unit.

12. The automatic universal power socket according to claim 1, further comprising a circuit unit and a sound receiver, the motor and the sound receiver being electrically connected to the circuit unit, the sound receiver being configured to receive voice commands to control the motor to drive the rotation of the rotating plate.

13. An automatic universal power socket comprising:

a socket unit having a plurality of electrically conductive strips and a plurality of pin holes disposed therein, the pin holes being universal pin holes and corresponding to the electrically conductive strips;

a rotating plate rotatably disposed on the socket unit and having a plurality of socket holes, the socket holes being of different socket types and corresponding selectively to the plurality of pin holes; and a motor connected with the rotating plate for driving the rotating plate to rotate.

14. The automatic universal power socket according to claim 13, wherein the motor is electrically connected to a control switch, the control switch controlling to the motor to drive the rotation of the rotating plate, or cutting off the power of the motor.

15. The automatic universal power socket according to claim 13, wherein the motor is connected to a first gear, the rotating plate has a second gear, and the first and second gears mesh with each other.

16. The automatic universal power socket according to claim 13, further comprising a circuit unit and a sound receiver, the motor and the sound receiver being electrically connected to the circuit unit, the sound receiver being configured to receive voice commands to control the motor to drive the rotation of the rotating plate.

17. An automatic universal power socket comprising:

a socket unit having a plurality of electrically conductive strips;

a rotating plate rotatably disposed on the socket unit and having a plurality of socket holes, the socket holes being of different socket types and corresponding selectively to the plurality of electrically conductive strips; and a motor connected with the rotating plate for driving the rotating plate to rotate.

18. The automatic universal power socket according to claim 17, wherein the motor is electrically connected to a control switch, the control switch controlling to the motor to drive the rotation of the rotating plate, or cutting off the power of the motor.

19. The automatic universal power socket according to claim 17, wherein the motor is connected to a first gear, the rotating plate has a second gear, and the first and second gears mesh with each other.

20. The automatic universal power socket according to claim 17, further comprising a circuit unit and a sound receiver, the motor and the sound receiver being electrically connected to the circuit unit, the sound receiver being configured to receive voice commands to control the motor to drive the rotation of the rotating plate.

* * * * *